US012007162B2

(12) United States Patent
Voltarelli et al.

(10) Patent No.: US 12,007,162 B2
(45) Date of Patent: Jun. 11, 2024

(54) STORAGE STRUCTURE FOR REFRIGERATOR APPLIANCE

(71) Applicant: Electrolux Do Brasil S.A., Curitiba (BR)

(72) Inventors: Antonio Voltarelli, Curitiba (BR); Israel Mercer, Curitiba (BR); Rafael Leidens, Curitiba (BR); Alcione Colecha, Curitiba (BR); Guilherme Picanço, Curitiba (BR)

(73) Assignee: Electrolux do Brasil S.A., Curitiba (BR)

( * ) Notice: Subject to any disclaimer, the term of this patent is extended or adjusted under 35 U.S.C. 154(b) by 887 days.

(21) Appl. No.: 16/971,906

(22) PCT Filed: Mar. 2, 2018

(86) PCT No.: PCT/BR2018/050053
§ 371 (c)(1),
(2) Date: Aug. 21, 2020

(87) PCT Pub. No.: WO2019/165521
PCT Pub. Date: Sep. 6, 2019

(65) Prior Publication Data

US 2021/0102750 A1 Apr. 8, 2021

(51) Int. Cl.
*F25D 25/02* (2006.01)
*A47B 88/75* (2017.01)
(Continued)

(52) U.S. Cl.
CPC ..... *F25D 25/025* (2013.01); *A47B 88/75* (2017.01); *A47B 96/025* (2013.01); *F25D 23/04* (2013.01);
(Continued)

(58) Field of Classification Search
CPC ..... A47B 88/75; A47B 96/025; F25D 25/025; F25D 25/024; F25D 23/04; F25D 23/067; F25D 2325/021
See application file for complete search history.

(56) References Cited

U.S. PATENT DOCUMENTS 2,711,944 A 6/1955 Meek
2,843,441 A 7/1958 Jewell
(Continued)

FOREIGN PATENT DOCUMENTS

EP 2749829 A2 7/2014
JP 11294943 A 10/1999
WO 2009155679 A2 12/2009

OTHER PUBLICATIONS

International Search Report and Written Opinion for International Application No. PCT/BR2018/050053, dated Apr. 2, 2019, 14 pages.

*Primary Examiner* — Henry T Crenshaw
(74) *Attorney, Agent, or Firm* — Pearne & Gordon LLP

(57) ABSTRACT

An adjustable shelf for a refrigerator includes a first and a second shelf portion being slidably moveable between extended and retracted positions. A frame includes a main track that guides the second shelf portion. An auxiliary external track is disposed on an extended lower edge of the frame, following the main track. A hook member is attached to and protrudes downwards from the second shelf portion, the hook member engaging with and sliding along the auxiliary external track to minimize lateral movement of a front end of the second shelf portion as the second shelf portion is slidably moved. In another embodiment, a freezer drawer assembly comprises first and second storage baskets. The second storage basket comprises front roller members that are seated on the first storage unit and are guided along a primary track by parallel, opposing track sidewalls.

14 Claims, 10 Drawing Sheets

(51) Int. Cl.
*A47B 96/02* (2006.01)
*F25D 23/04* (2006.01)
*F25D 23/06* (2006.01)

(52) U.S. Cl.
CPC ..... *F25D 23/067* (2013.01); *F25D 2323/021* (2013.01); *F25D 2325/021* (2013.01)

(56) References Cited

U.S. PATENT DOCUMENTS 2,955,441 A 10/1960 DahlGren
5,735,589 A * 4/1998 Herrmann ..... B29C 33/123 312/334.44
5,980,009 A 11/1999 Atalla et al.
6,641,239 B2 11/2003 Kaiser
6,851,775 B2 2/2005 Kaiser
6,971,730 B2 12/2005 Koons
7,240,980 B2 7/2007 Koons
7,406,833 B2 8/2008 Ertz et al.
7,712,852 B2 5/2010 Choi et al.
7,740,331 B2 6/2010 Koo
7,744,173 B2 6/2010 Maglinger et al.
7,997,667 B2 8/2011 Rotter et al.
8,141,968 B2 3/2012 Velarde et al.
8,157,338 B2 4/2012 Seo et al.
8,210,625 B2 7/2012 Rotter et al.
8,562,088 B2 10/2013 Lim et al.
8,668,290 B2 3/2014 Rotter et al.
8,864,249 B2 10/2014 Nam et al.
9,146,052 B2 9/2015 Nam et al.
9,146,053 B2 9/2015 Nam et al.
9,513,049 B2 12/2016 Eisele et al.
9,523,533 B2 12/2016 Nam et al.
9,557,096 B2 1/2017 Hong et al.
9,638,459 B2 5/2017 Choi et al.
9,677,807 B2 6/2017 Shin
2003/0117050 A1* 6/2003 Hamilton ..... F25D 25/024 312/351
2004/0056573 A1 3/2004 Chae
2007/0018548 A1 1/2007 Ertz et al.
2007/0227180 A1 10/2007 Koons
2009/0193836 A1 8/2009 Ertz et al.
2011/0232322 A1 9/2011 Noel et al.
2012/0091084 A1* 4/2012 Amaral ..... F25D 25/024 211/80
2014/0265803 A1* 9/2014 Kelly ..... F25D 25/024 312/404
2015/0377548 A1 12/2015 Nam et al.
2016/0153704 A1 6/2016 Burke et al.
2016/0356538 A1 12/2016 Park et al.
2017/0010039 A1 1/2017 Hong et al.

* cited by examiner

STORAGE STRUCTURE FOR REFRIGERATOR APPLIANCE

This application is a U.S. National Phase application of PCT International Application No. PCT/BR2018/050053, filed Mar. 2, 2018, which is incorporated by reference herein.

FIELD OF THE INVENTION

This application relates generally to a refrigeration appliance, and more particularly, to a storage structure for a refrigeration appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional refrigerator appliances typically include various storage structures for storing food items within their compartment(s). For instance, a refrigerator can include one or more storage bins or shelves for storing food items. A shelf can be mounted within a storage compartment and can provide a flat, level surface for food items to be stored thereon. An object of the present disclosure is to provide improvements to the storage structure(s) of conventional refrigerator appliances.

BRIEF SUMMARY OF THE INVENTION

In accordance with a first aspect, there is provided a refrigerator with an adjustable shelf. The refrigerator comprises a food compartment with a rear wall and a door configured to provide access to the food compartment. The adjustable shelf for storing food items within the food compartment is attached to the rear wall. The adjustable shelf comprises a first shelf portion comprising a first planar support surface for supporting food items thereon that is arranged normal to the rear wall, and a second shelf portion comprising a second planar support surface for supporting food items thereon. The second shelf portion is slidably moveable relative to the first shelf portion between an extended position and a retracted position. At the extended position, the second shelf portion is arranged relative to the first shelf portion such that the second planar support surface is substantially coplanar with the first planar support surface. At the retracted position, a majority of the second planar support surface is arranged subjacent to the first planar support surface. A frame is configured to support the first and the second shelf portions, wherein the frame includes two opposed side arms that each include a main track that guides the second shelf portion as the second shelf portion is slidably moved between the extended and retracted positions. An auxiliary external track is disposed on an extended lower edge of the frame, the auxiliary external track following the main track, and a hook member is attached to and protruding downwards from the second shelf portion. The hook member engages with and slides along the auxiliary external track to minimize lateral movement of a front end of the second shelf portion as the second shelf portion is slidably moved between the extended and retracted positions In some examples of the first aspect, the auxiliary external track comprises a planar wall. In some examples, the auxiliary external track is an extension of an interior sidewall of the frame. Further in some examples, the main track comprises a ramped, front drop down channel and a horizontal section, and the auxiliary external track has a ramped front portion that extends below and follows the front drop down channel, and a horizontal portion that follows along the horizontal section of the main track.

Further in some examples of the first aspect, the hook member has a "J"-shaped geometry. In some examples, the hook member comprises an interior arm that extends downwardly from the second shelf portion, an exterior arm, and a projecting guide interconnected between the interior and exterior arms. Further in some examples, the second shelf portion comprises a body that supports the second planar support surface, and the interior arm extends downwardly from the body. In some examples, the guide has a width slightly wider than a thickness of the auxiliary external track so that the auxiliary external track is captured between the interior and exterior arms.

Still further in some examples of the first aspect, the main track further comprises a hole extending therethrough to disengage the hook member from the auxiliary external track. In other examples, the hole is located is immediately beyond a terminal end of the auxiliary external track. In another example, the hole is of sufficient size to enable the hook member to completely pass through the main track. In yet another example, the first shelf portion is pivotally connected to the frame and, in the retracted position, the second shelf portion is coupled to the first shelf portion so that first and second shelf portions can be rotated upwards as a single unit. In other examples, the hook member passes without obstruction vertically upwards through the hole in the main track when the first and second shelf portions are rotated upwards.

In yet further examples of the first aspect, a pair of auxiliary external tracks are disposed one each on the opposed side arms of the frame, and a pair of hook members disposed one on each side of the second shelf portion that are engaged with and ride along the auxiliary external tracks on both opposed side arms.

In accordance with a second aspect, there is provided a freezer drawer assembly for a refrigerator comprising a freezer compartment located vertically below a fresh food compartment. The freezer drawer assembly comprises a freezer door slidably mounted in the freezer compartment to selectively grant a user access to food items stored in the freezer compartment. A first storage basket is movable in association with closing and opening operations of the freezer door, and a sidewall of the first storage basket comprising planar upper flange surface. A primary track is provided on the planar upper flange surface, and the primary track comprising a pair of parallel, opposing track sidewalls that define a path extending linearly along the planar upper flange surface in a direction of the freezer door opening and closing motion. A second storage basket comprises front roller members and rear roller members. The front roller members support a front end of the second storage basket and are mounted to front corners of the second storage basket. The front roller members are seated on the planar upper flange surface of the first storage basket to enable rolling movement thereof. The front roller members are disposed between the track sidewalls and are guided along the path of the primary track by the track sidewalls as the second storage basket is being inserted and withdrawn. The rear roller members support a rear end of the second storage basket and are provided on exterior side walls of the second storage basket to move along a secondary track that is coupled to a side wall of the freezer compartment as the second storage basket is being inserted and withdrawn.

In some examples of the second aspect, the opposing track sidewalls project upwards from, and stand proud upon, the planar upper flange surface. In other examples, at a rearward end of the path, the primary track includes a rear wall that interconnects the opposing track sidewalls, and wherein at a front end of the path, the primary track is open.

Further in some examples of the second aspect, the first storage basket is supported within the freezer compartment by a linear motion element that is attached to a support bracket on an interior side wall of the freezer compartment, and wherein the secondary track is provided on an upper wall of the support bracket.

Still further in some examples of the second aspect, a bottom wall of the second storage basket further comprises a depending arm with a protrusion, and one of the track sidewalls of the primary track further comprises an inwardly-projecting flange. The protrusion slidably engages an underside of the inwardly-projecting flange as the second storage basket is being inserted and withdrawn to inhibit the front roller members from moving vertically out of the primary track. In other examples, a front stop that extends inwardly from to the primary track for engagement with the protrusion of the depending arm to inhibit motion of the second storage basket in a direction of the freezer door opening and closing motion.

DESCRIPTION OF EXAMPLE EMBODIMENTS

Figure 1:
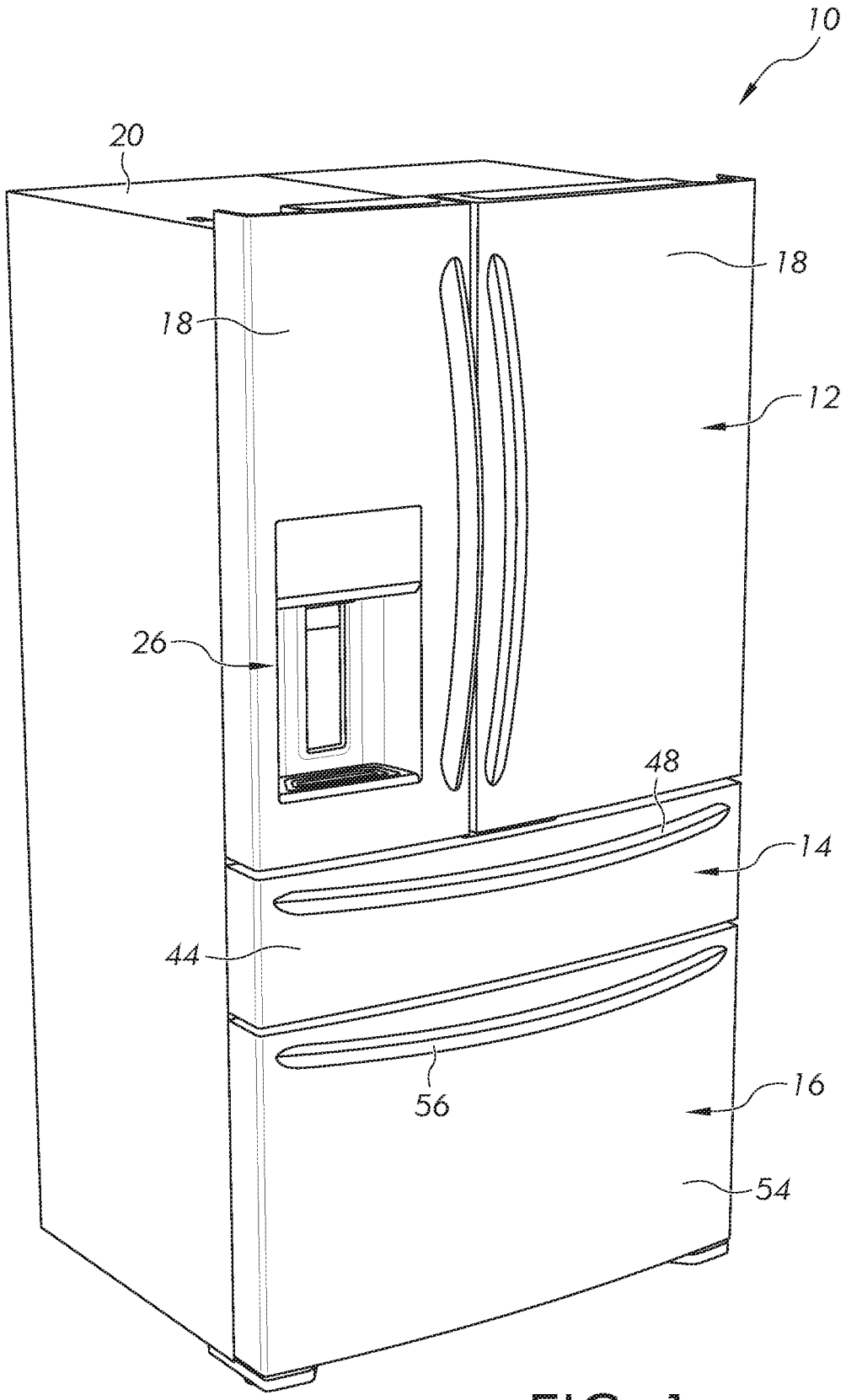
FIG. 1 is a front perspective view of a household French Door Bottom Mount refrigerator showing doors of the refrigerator in a closed position.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 12 disposed vertically above a variable climate zone (VCZ) compartment 14 and a freezer compartment 16.

Two doors 18 shown in FIG. 1 are pivotally coupled to a cabinet 20 of the refrigerator 10 to restrict and grant access to the fresh food compartment 12. The doors 18 are French-type doors that collectively span the entire lateral distance of the entrance to the fresh food compartment 12 to enclose the fresh food compartment 12. A center flip mullion 22 (FIG. 2) is pivotally coupled to at least one of the doors 18 to establish a surface against which a seal provided to the other one of the doors 18 can seal the entrance to the fresh food compartment 12 at a location between opposing side surfaces 24 (FIG. 2) of the doors 18. The mullion 22 can be pivotally coupled to the door 18 to pivot between a first orientation that is substantially parallel to a planar surface of the door 18 when the door 18 is closed, and a different orientation when the door 18 is opened. The externally-exposed surface of the center mullion 22 is substantially parallel to the door 18 when the center mullion 22 is in the first orientation, and forms an angle other than parallel relative to the door 18 when the center mullion 22 is in the second orientation. In the embodiment shown in FIG. 1, the seal and the externally-exposed surface of the mullion 22 cooperate at a position offset from a centerline midway between the lateral sides of the fresh food compartment 12. It is contemplate that the seal and the externally-exposed surface of the mullion 22 can cooperate approximately midway between the lateral sides of the fresh food compartment 12.

A dispenser 26 (FIG. 1) for dispensing at least ice pieces, and optionally water, can be provided on an exterior of one of the doors 18 that restricts access to the fresh food compartment 12. The dispenser 26 includes a lever, switch, proximity sensor or other device that a user can interact with to cause frozen ice pieces to be dispensed from an ice bin (not shown) of an ice maker 28 disposed within the fresh food compartment 12. Ice pieces from the ice maker 28 can exit the ice maker 28 through an aperture (not shown) and be delivered to the dispenser 26 via an ice chute (not shown), which extends at least partially through the door 18 between the dispenser 26 and the ice maker 28.

The refrigerator 10 includes an interior liner 30 (FIG. 2) that defines the fresh food compartment 12. In particular, the interior liner 30 can define a bottom wall 32, a top wall 34, a rear wall 36, a left side wall 38, and a right side wall 40 of the fresh food compartment 12. The fresh food compartment 12 is located in the upper portion of the refrigerator 10 in this example and serves to minimize spoiling of articles of food stored therein. The fresh food compartment 12 accomplishes this by maintaining the temperature in the fresh food compartment 12 at a cool temperature that is typically above 0° C., so as not to freeze the articles of food in the fresh food compartment 12. It is contemplated that the cool temperature preferably is between 0° C. and 10° C., more preferably between 0° C. and 5° C. and even more preferably between 0.25° C. and 4.5° C. A separate fresh food evaporator (not shown) is dedicated to separately maintaining the temperature within the fresh food compartment 12 independent of the freezer compartment 16. According to an embodiment, the temperature in the fresh food compartment 12 can be maintained at a cool temperature within a close tolerance of a range between 0° C. and 4.5° C., including any subranges and any individual temperatures falling with that range. For example, other embodiments can optionally maintain the cool temperature within the fresh food compartment 12 within a reasonably close tolerance of a temperature between 0.25° C. and 4° C.

Figure 2:
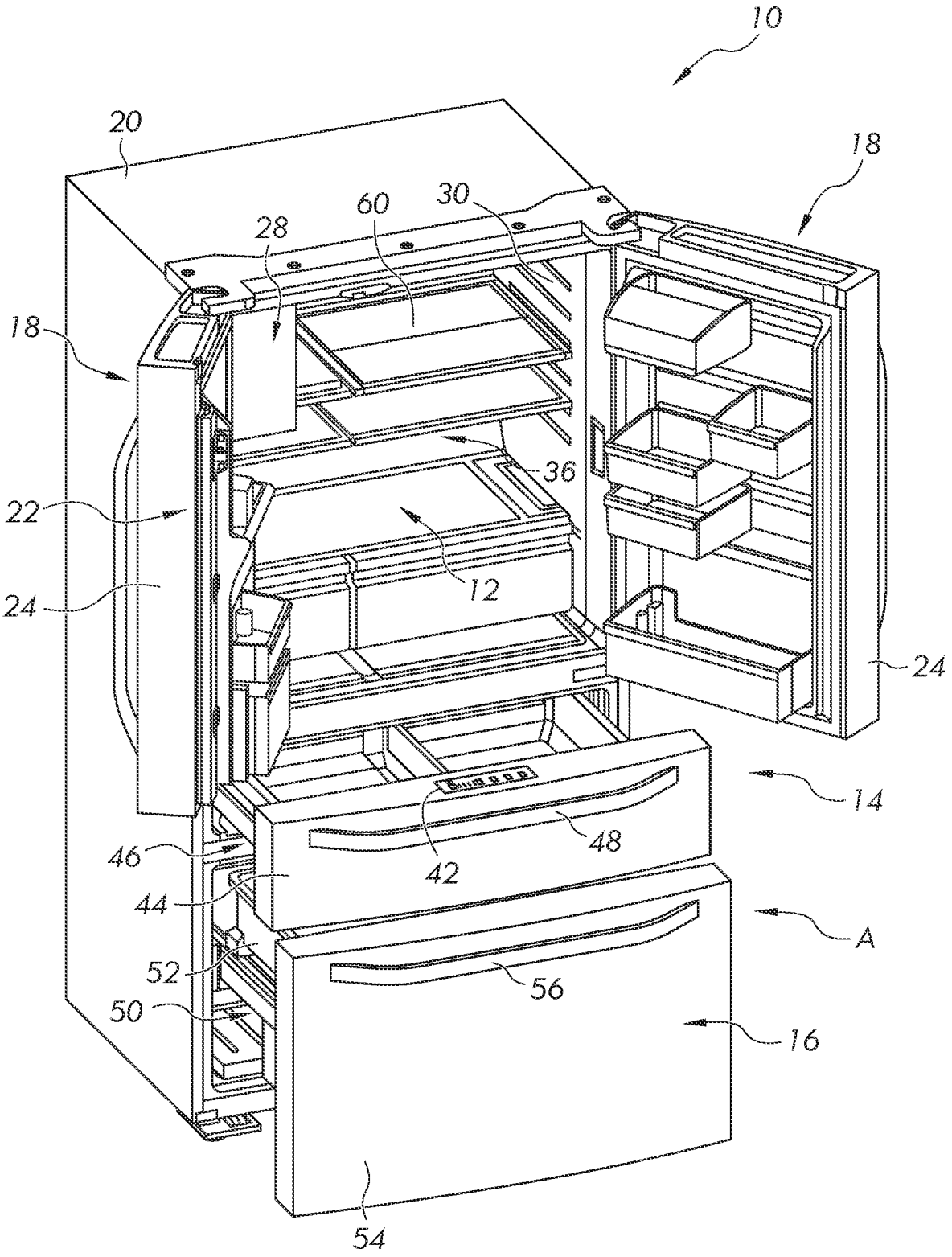
FIG. 2 is a front perspective view of the refrigerator showing doors of a fresh food compartment and drawers of a freezer compartment and a variable climate zone compartment in an opened position.

Referring to FIG. 2, the VCZ compartment 14 is arranged vertically beneath the fresh food compartment 12. The VCZ compartment 14 can operate at different user-selectable temperatures as either a refrigerator (i.e., above-freezing) or a freezer (i.e., below-freezing). A control unit or user interface 42 is disposed on a front panel 44 of the VCZ compartment 14 to allow a user the ability to selectively operate the VCZ compartment 14 at one of a variety of temperatures including both true fresh food and freezing temperatures, for example, −18° C., −12° C., −2 C, 0° C. and +4° C. The VCZ compartment 14 is fluidly in communication with the freezer compartment 16 and may include a heater (not shown) for heating the air conveyed to the VCZ compartment 14, if desired. The front panel 44 is part of a drawer assembly 46 that can be withdrawn from the VCZ compartment 14 to grant a user access to food items stored in the VCZ compartment 14. A handle 48 can be coupled to the front panel 44 to allow a user to pull the drawer assembly 46 to an extended position and thereby access the food items.

The freezer compartment 16 is arranged vertically beneath the VCZ compartment 14. A drawer assembly 50 including one or more freezer baskets 52 can be withdrawn from the freezer compartment 16 to grant a user access to food items stored in the freezer compartment 16. The drawer assembly can be coupled to a freezer door 54 that includes a handle 56. When a user grasps the handle 56 and pulls the freezer door 54 open, at least one or more of the freezer baskets 52 is caused to be at least partially withdrawn from the freezer compartment 16.

The freezer compartment 16 is used to freeze and/or maintain articles of food stored in the freezer compartment 16 in a frozen condition. For this purpose, the freezer compartment 16 is in thermal communication with a freezer evaporator (not shown) that removes thermal energy from the freezer compartment 16 to maintain the temperature therein at a temperature of 0° C. or less during operation of the refrigerator 10, preferably between 0° C. and −50° C., more preferably between 0° C. and −30° C. and even more preferably between 0° C. and −20° C. The freezer compartment 16 is also in communication with the VCZ compartment 14 such that a portion of the cooling air supplied to the freezer compartment 16 can be selectively supplied to the VCZ compartment 14.

As shown in FIG. 2, the refrigerator 10 can include one or more shelves, and in particular, an adjustable shelf 60 to store food thereon. As shown, the adjustable shelf 60 can be of a slide-under shelf type that comprises a first shelf portion and a second shelf portion, each of which extends about half of the length of two side support arms. In a retracted state, the second shelf portion is stored under the first shelf portion, and is pulled outward along rails of the side support arms to extend or retract the shelving area. Therefore, as the second shelf portion slides out from under the first shelf portion, the adjustable shelf 60 is considered a slide under shelf. Furthermore, the two shelf portions are capable of being folded up completely (by way of rotation) to a vertical position against the back wall of the cabinet. Thus, the aforementioned shelf configuration increases the vertical storage capacity of a lower shelf or storage area.

Although the various figures show the adjustable shelf in the fresh food compartment 12, the adjustable shelf may also be installed in the freezer compartment 16 and/or the VCZ compartment 14. The embodiment of the present disclosure describes an example in which, for convenience of explanation, the shelves are installed in the fresh food compartment 12.

Figure 3:
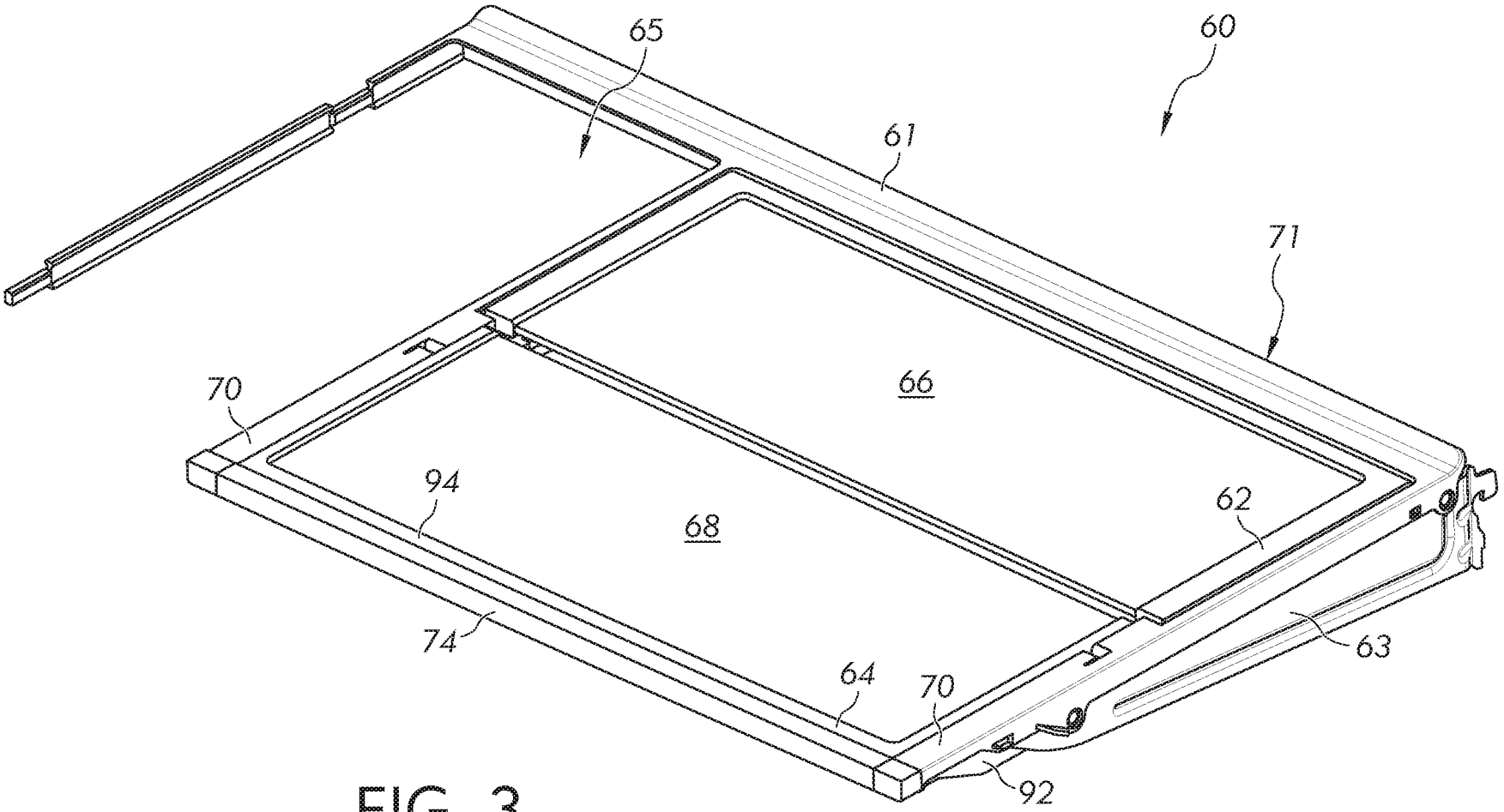
FIG. 3 is a perspective view of an adjustable shelf in an extended position.

Turning to FIG. 3, an example adjustable shelf 60 for the refrigerator 10 will now be described. The adjustable shelf 60 as shown in FIG. 3 is in the extended position. The first and second shelf portions 62, 64 respectively include a first planar support surface 66 and a second planar support surface 68, both of which can be used as surfaces to store items on within the food compartment. The first planar support surface 66 is arranged normal to the rear wall of the fresh food compartment. The first shelf portion 62 is a rear shelf, while the second shelf portion 64 is a front shelf. The support surfaces 66, 68 are removable or non-removable rigid surfaces to support items within the refrigerator, and are preferably transparent or translucent (such as glass sheets) that are inserted into the shelf portions 62, 64. Alternatively, the support surfaces 66, 68 can be integrally formed with the shelf portions 62, 64. For ease of illustration, the drawings in the present disclosure may show the support surfaces 66, 68 as an opaque structure; however, this is not intended to be a limitation.

The adjustable shelf 60 further includes shelf frame 61 that is retained upon a pair of metal support brackets 63 within the cabinet of the refrigerator. The frame 61 can be removably or non-removably secured to the support brackets 63. The frame 61 can be substantially rigid, such as metal or plastic formed via an injection molding process. The frame 61 includes two opposed side arms 70 that are arranged in parallel and extend from a back portion 71. The back portion 71 is arranged horizontal and substantially parallel to the rear wall of the refrigerator compartment such that the side arms 70 project normally from the rear wall. The adjustable shelf 60 can be mounted within the fresh food compartment 12 in a variety of different manners. The frame 61 can be integral with the food compartment, or the frame 61 can be a separate component. For example, the refrigerator 10 can include one or more support bodies (e.g., brackets, ledges, surfaces, etc.) integrally formed with the interior liner and a separate frame 61 can rest on ledges provided along the walls of the food compartment. Alternatively, as shown, the frame 61 can be fixed to the metal support brackets 63 (one per each side arm 70), which are mounted to the food compartment using hooks 67 removably or non-removably mountable onto a ladder track or the like secured to the rear wall of the compartment liner, and which cantilever the frame 61 from the rear wall. For example, the fresh food compartment 12 can comprise a plurality of apertures that the hook(s) 67 of each support bracket 63 can engage (e.g., be inserted into) to cantilever the support bracket 63 from the rear wall. In particular, the fresh food compartment 12 can comprise two vertically aligned tracks (often referred to as ladder tracks) that are fixed to its rear wall and define two or more vertically-aligned rows of apertures that will permit the support brackets 63 to be installed at various heights along the rear wall. The frame 61 can also be mounted using other fastening structure such as bolts, screws, adhesive, or the like, and may even include locking structure to inhibit inadvertent removal from the refrigerator. The shelf frame 61 may support only the adjustable shelf 60, or alternatively in the shown example, the shelf frame 61 may have a "U-shaped" geometry and supports more than one shelf. For example, a secondary shelf area 65 may support an adjacent fixed or moveable shelf, such as a flip-up shelf or other suitable shelf.

In the extended position, as shown in FIG. 3, the first shelf portion 62 is arranged such that the first planar support surface 66 is normal to the rear wall and the pair of opposed side walls of the refrigerator cabinet liner. Additionally, the second planar support surface 68 is arranged relative to the first shelf portion 62 such that the second planar support surface 68 is substantially coplanar with the first planar support surface 66. Thus, in the extended position, the two support surfaces 66, 68 can form a larger single support surface. Still, it is understood that the support surfaces 66, 68 may be separated by a relatively small gap. When the second shelf portion 64 is in the extended position, the second shelf portion 64 can present an obstruction relative to a lower refrigerator shelf that can limit the dimensions and quantity of food items that may rest on said lower shelf such as tall bottles or the like. To alleviate this problem, one of the shelf portions (such as the second shelf portion 64) of the adjustable shelf 60 can be slidably moveable, relative to the other shelf portion (such as the first shelf portion 62), between an extended position and a retracted position.

Figure 4:
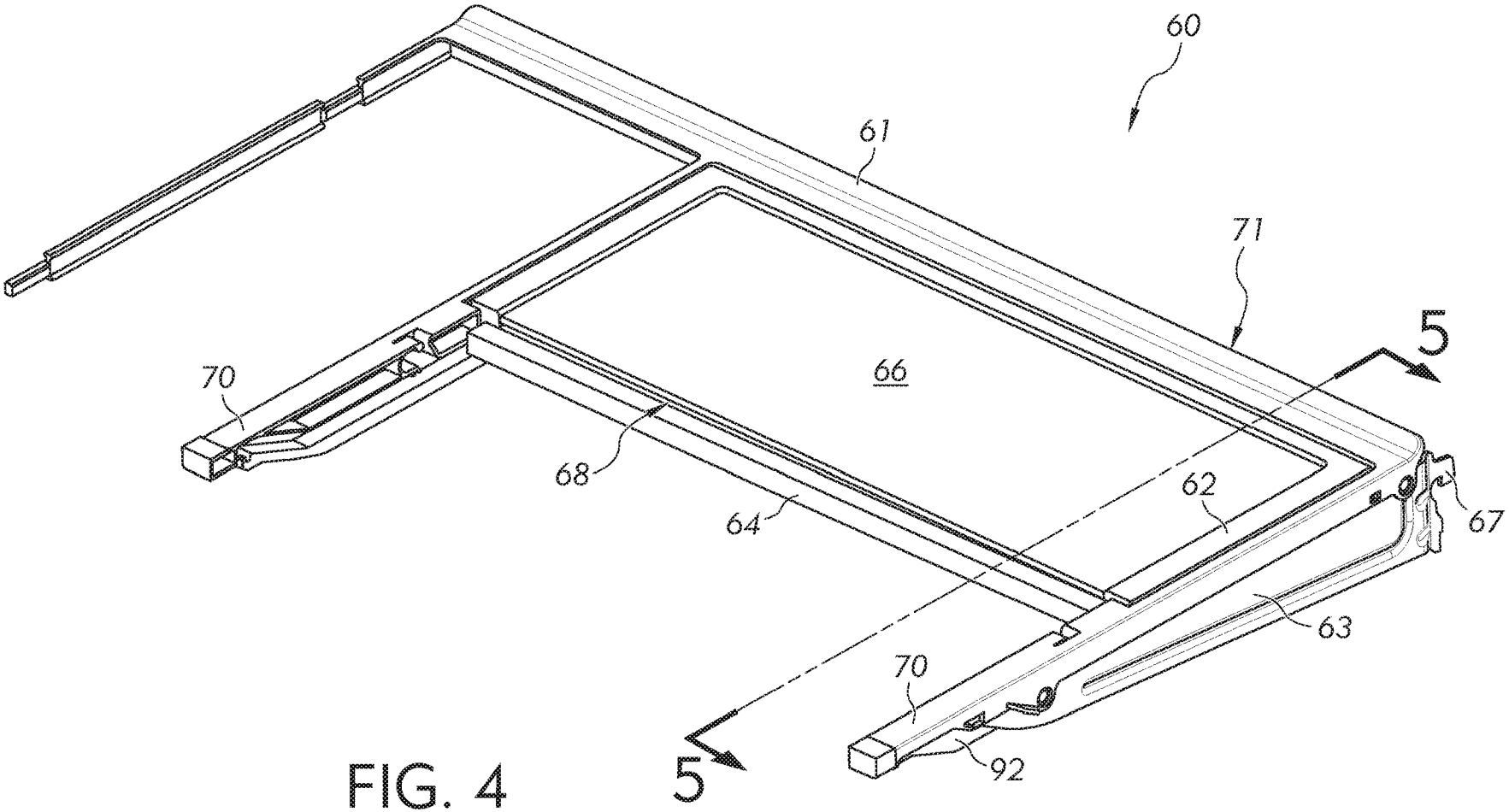
FIG. 4 is a perspective view of the adjustable shelf in a retracted position.

FIG. 4 shows the second shelf portion 64 in the retracted position. When the second shelf portion 64 is in the retracted position, the second planar support surface 68 is arranged subjacent to the first planar support surface 66. Preferably, the second planar support surface 68 has a width and a depth that are, respectively, substantially equal to or less than the width and depth of the first planar support surface 66 so that a majority (such as all) of the second planar support surface 68 is arranged subjacent to the first planar support surface 66 in the retracted position. However, it is contemplated that there may be embodiments wherein the second planar support surface 68 is not entirely subjacent to the first planar support surface 66 in the retracted position, and even embodiments where less than a majority of the second planar support surface 68 is arranged subjacent to the first planar support surface 66.

The adjustable shelf 60 can thus be used in conjunction with a series of vertically spaced shelves, where it is desirable at some times to be able to accommodate tall or bulky items with the least amount of preparation or manipulation by slidably moving the second shelf portion 64 into the retracted position underneath the first shelf portion 66, so that tall or bulky items can be stored beneath the adjustable shelf 60 where the second shelf portion 64 would normally be located in the extended position. Meanwhile, when greater support surface area is desired within the fresh food compartment 12, the second shelf portion 64 can be slidably moved to the extended position to increase the total support surface area of the adjustable shelf 60.

Figure 5:
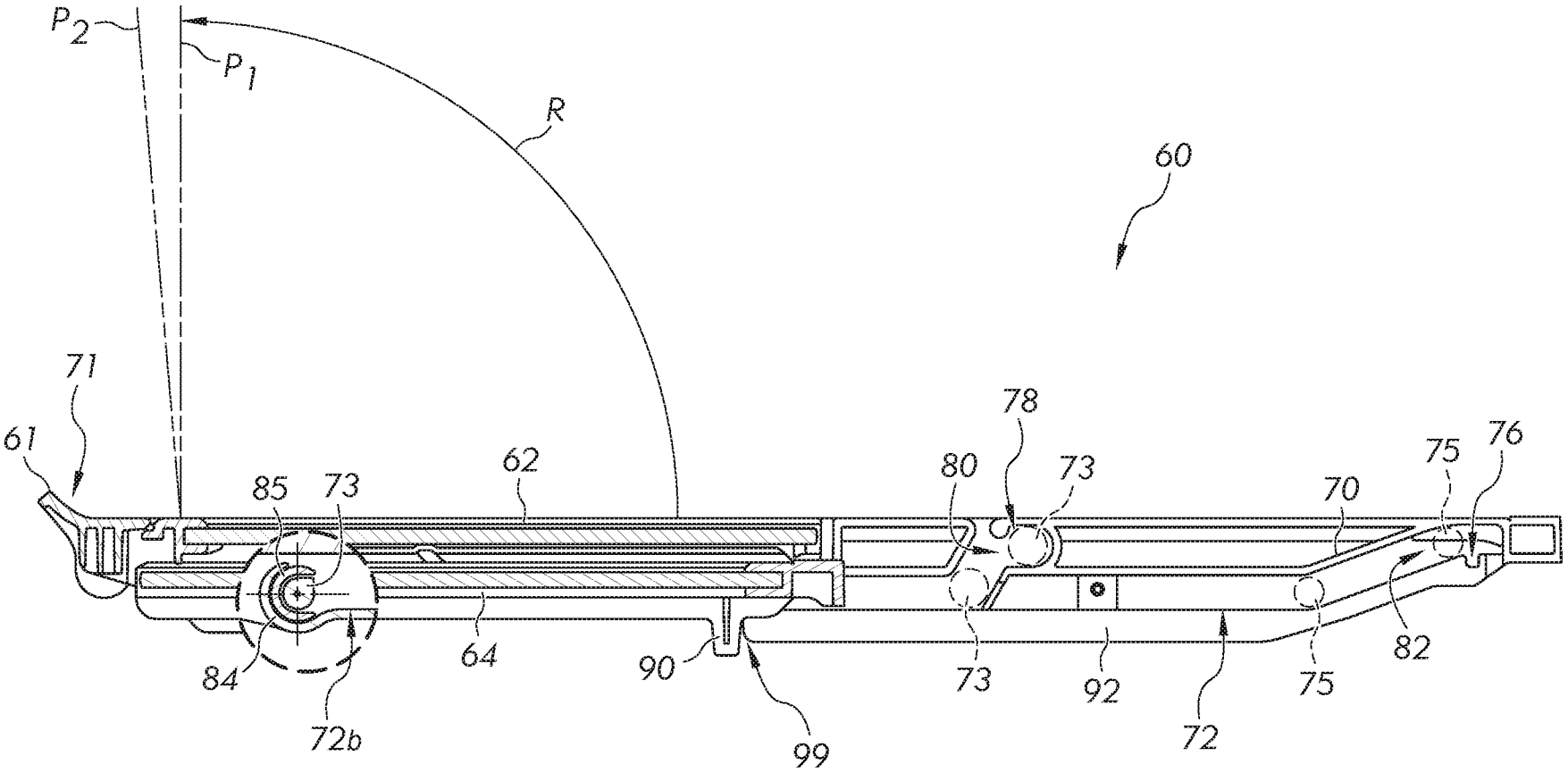
FIG. 5 is a side sectional view of the adjustable shelf showing a track.

Turning to FIG. 5, the sliding mechanism for the adjustable shelf 60 will now be discussed in further detail. The adjustable shelf 60 can include a main track 72 arranged on an interior surface of each side arm 70 of the frame 61. The tracks 72 are in parallel alignment and are configured to guide the second shelf portion 64 as it is slidably moved between the extended and retracted positions. The tracks 72 begin adjacent a forward end of each side arm 70 and traverse rearwardly along at least partially along the side arms a sufficient distance to enable the second shelf portion 64 to be fully seated below the first shelf portion 62. Each side of the second shelf portion 64 further comprises forward and rear projecting stub shafts that engage with and slide along the tracks 72, as will be described.

To retract the second shelf portion 64 so as to transition from the extended position to the retracted "Half shelf" position, a user first lifts an exposed front end 74 of the second shelf portion 64 to release the second shelf portion 64 from a recessed lock area 76 disposed within a guiding member of the shelf frame. Thereafter, application of minimal force in an inwards direction will cause a rear stub shaft 73 (shown in two positions in FIG. 5) located at the inward (i.e., rear) edge of the second shelf portion 64 to be released from a locking enclosure 78 and begin moving beneath the first shelf portion 62. In essence, the rear stub shaft 73 of the second shelf portion 64 will be released from the snap-fit locking enclosure 78 and fall down a rear drop down channel 80. As shown, the rear drop down channel 80 has a relatively steeper decline than that of a ramped, forward drop down channel 82. When the rear stub shaft 73 of the second shelf portion 64 has fully dropped, then the user may apply additional force in an inward (i.e., rearward) direction; as such, a front stub shaft 75 (shown in two positions in FIG. 5) of the second shelf portion 64 will begin traversing down the forward drop down channel 82. The front stub shaft 75 will continue to move rearwardly along the generally horizontal main track 72. Eventually, as shown in FIG. 5, the second shelf portion 64 will be positioned fully beneath the first shelf portion 62; in such a configuration (i.e., the retracted "Half shelf" position), the planar surfaces of both the first and second shelf portions 62, 64 lie on parallel, vertically spaced, horizontal planes. In this configuration, rear stub shaft 73 will be located or captured within a "C"-shaped recess 85 molded into the underside of the first shelf portion 62 (see FIG. 6).

Optionally, the adjustable shelf 60 can be configured to fold the shelf up completely to a vertical position. From the retracted "Half shelf" position, the first and second shelf portions 62, 64 can be lifted (i.e., by way of rotation about arrow R), as a single unit, to permit the complete shelf (i.e., both the front and back shelf portions) to be positioned vertically (i.e., reference $P_1$, 90° or more from the "Half shelf" positions); thus increasing the vertical height capacity of a lower shelf or storage area. To remain in the vertical position, the complete shelf can rotate beyond 90° (e.g., reference $P_2$, approximately 110-120° such that the shelf rests against the back portion 71 of the shelf frame 61 and/or back wall of the cabinet. In one example, at the end of a rear portion 72*b* of the main track 72, the rear stub shafts 73 of the second shelf portion 64 can engage and be captured within a "C-shaped" recess 85 molded into the underside of the first shelf portion 62 (see detail area of FIG. 5) such that both shelf portions can rotate at least 90° upwards about a common axis. Preferably, the common axis is defined by a "C"-shaped pivot point 84 molded into the side arms 70 of the shelf frame 61 (see detail area of FIG. 5). The "C"-shaped pivot point 84 projects inwardly from the interior side wall of the side arm 70, and is located at a terminal end of the rear portion 72*b* of the main track 72. The "C"-shaped recess 85 of the first shelf portion 62 projects outwardly towards the "C"-shaped pivot point 84, and is "C"-shaped so that the rear stub shaft 73 can readily be inserted and removed therefrom as the second shelf portion 64 is moved between the extended and retracted positions. Preferably, at least the "C"-shaped pivot point 84 of the side arm 70 is co-axial with "C"-shaped recess 85 of the first shelf portion 62. More preferably, when the second shelf portion 64 is in the retracted position, the rear stub shaft 73 is also co-axial therewith so that all of the "C"-shaped pivot point 84, "C"-shaped recess 85, and rear stub shaft 73 are rotationally nested together. In this manner, both of the first and second shelf portions 62, 64 can rotate together about the common rotational axis defined by the "C"-shaped pivot point 84.

Figure 6:
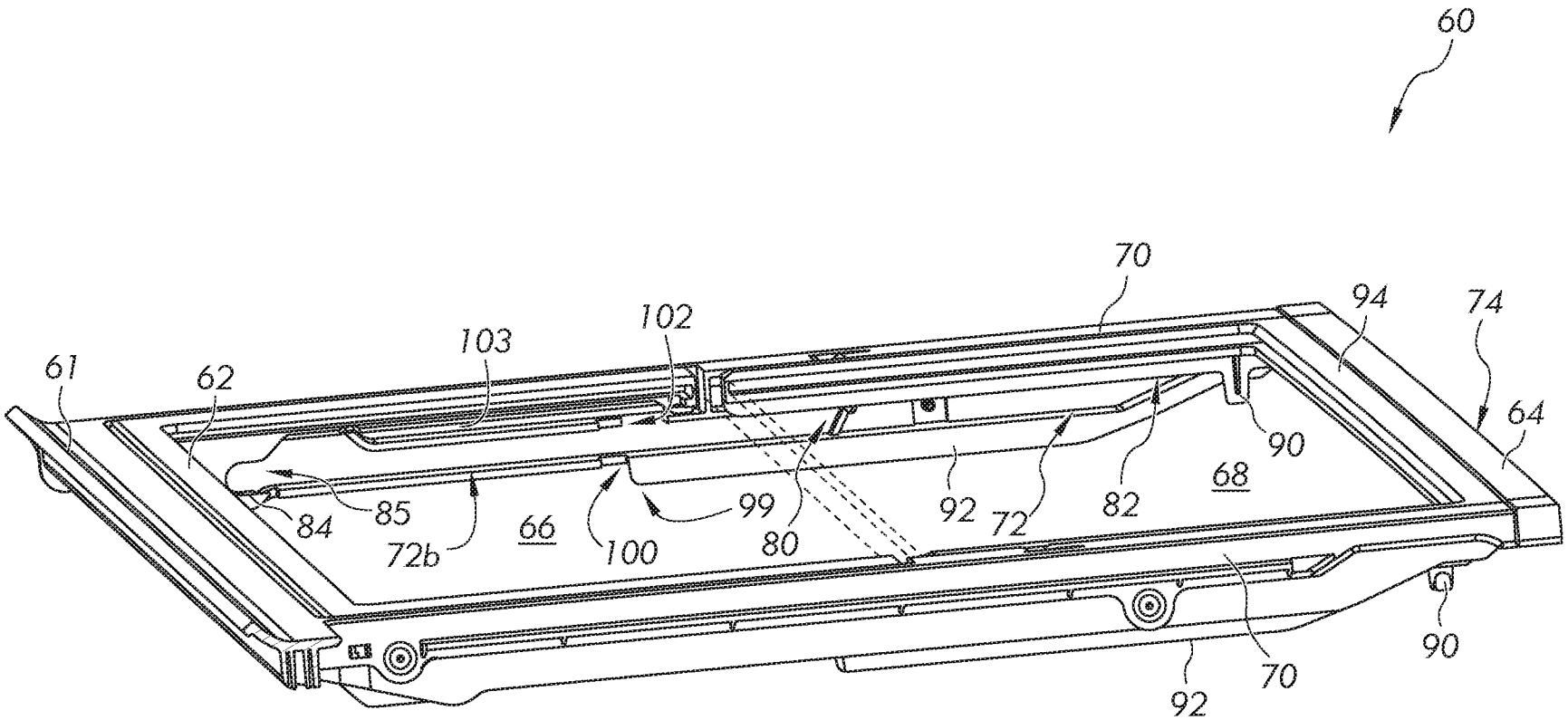
FIG. 6 is a rear perspective view of the adjustable shelf.

Turning now to FIG. 6, during the sliding motion between the extended and retracted positions, the second shelf portion 64 may experience undesirable lateral movement when the exposed front end 74 of the second shelf portion 64 is released from the recessed locking areas 76 of the shelf frame 61. To alleviate this effect, the second shelf portion 64 can further include hook members 90 that engage with and slide along an auxiliary external track 92 on an extended lower edge of the frame 61 in order to substantially minimize the above-noted lateral movement. Preferably, both sides of the second shelf portion 64 include hook members 90 that are engaged with and ride along the auxiliary external track 92 on both of the side arms 70. That is, a pair of hook members 90 can be engaged with a corresponding pair of auxiliary external tracks 92. The hook members 90 and auxiliary external tracks 92, respectively, can be substantially identical on both sides of the frame 61.

The hook members 90 are positioned on a body 94 of the second shelf portion 64. The body 94 is the rigid frame that supports the second planar support surface 68, and may be formed of a molded plastic or metal. For example, the body 94 can be overmolded onto the support surface 68, or in other examples can be attached by other processes, such as mechanically clamped or adhesive attachment. The hook members 90 are located toward the exposed front end 74 of the second shelf portion 64, and are on the exterior-facing sides of the body 94 adjacent to the track 72. The hook members 90 may be set back a short distance from the front end 74, as shown in FIG. 6. Preferably, the hook members 90 are integrally formed with the body 94 of the second shelf portion 64 as a monolithic unit, although it is contemplated that the hook members 90 could also be separately attached. Generally, the hook members 90 protrude downwards from the frame and comprise a "J"-shaped geometry that wraps around the auxiliary external track 92 of the frame 61.

The auxiliary external track 92 of the frame 61 is an extended surface, preferably a planar wall, that projects downwardly from a bottom of the frame 61. In one example, the auxiliary external track 92 is an extension of the interior sidewall of the frame 61. The auxiliary external track 92 extends generally along and follows the main track 72. That is, as best seen in FIG. 5, the auxiliary external track 92 begins generally near the locking area 76 and has a ramped front portion that follows and extends below the front drop down channel 82. The auxiliary external track 92 then has a generally horizontal portion that follows along the generally horizontal section of the main track, and continues a distance past the rear drop down channel 80.

Figure 7:
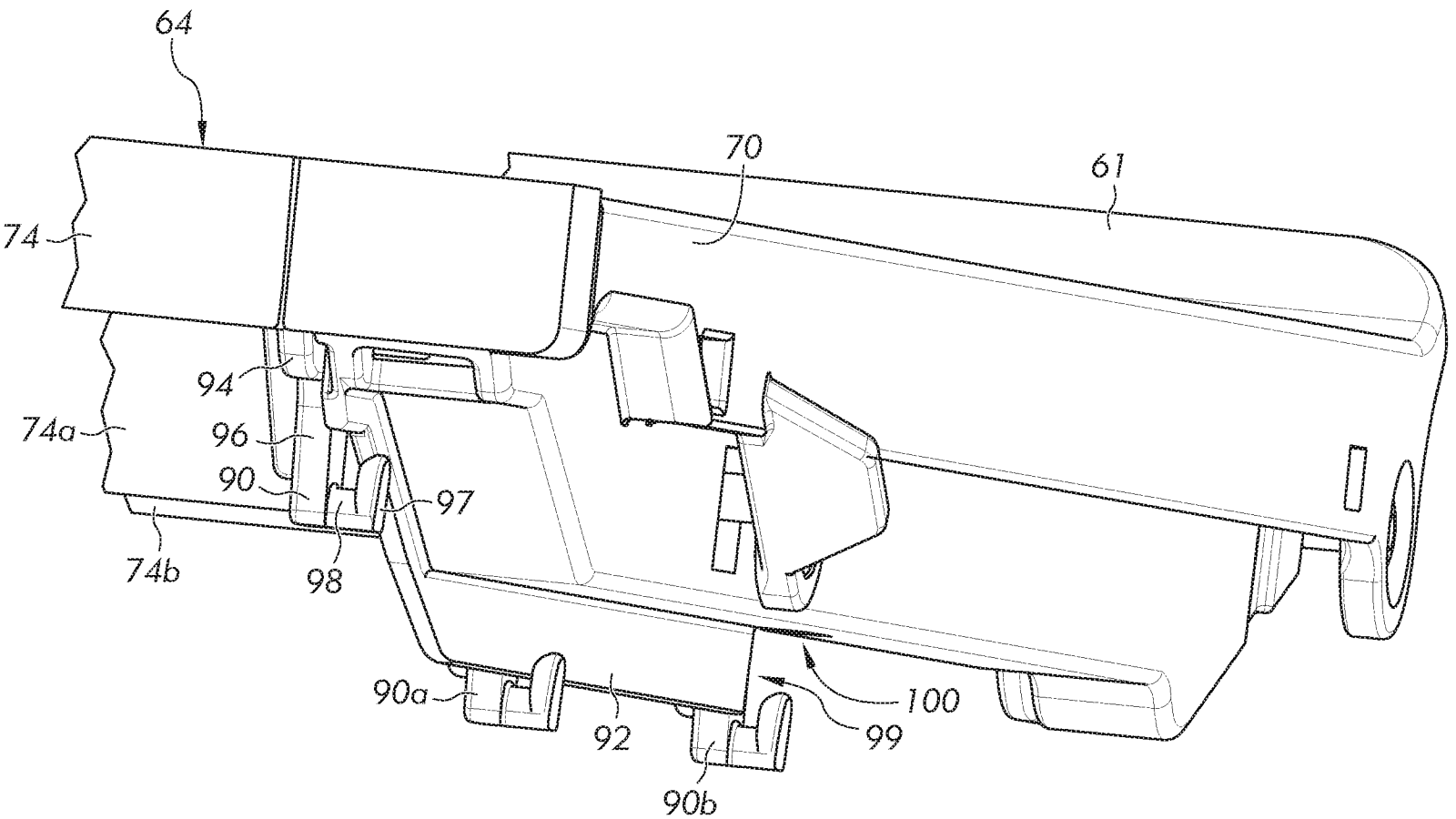
FIG. 7 is a partial perspective view showing an underside of the track.

As shown in FIG. 7 (which shows a partial perspective view showing an underside of the side arms 70), each hook member 90 comprises an interior arm 96 that extends downwardly from the body 94, an exterior arm 97, and a projecting guide 98 interconnected therebetween. In this way, the "J"-shaped geometry wraps about the auxiliary external track 92. The hook member 90 can be a monolithic body, such as an integrally molded part. Preferably, the interior and exterior arms 96, 97 are parallel, although the exterior arm 97 can be relatively shorter. The guide 98 has a width slightly wider than the thickness of the auxiliary external track 92, so that the auxiliary external track 92 is captured between and readily glides between the interior and exterior arms 96, 97 as the hook member 90 travels along the side arms 70. Preferably, there is only a slight distance between each of the interior and exterior arms 96, 97 and the lower edge so as to minimize the lateral movement of the of the second shelf portion 64 relative to the frame 61. Similarly, there is little or no distance between the guide 98 and the auxiliary external track 92. Additionally, the guide 98 can have various geometries to facilitate sliding contact with the auxiliary external track 92. In one example, the guide 98 can have a rounded, generally convex geometry that smoothly rides along a corresponding profile of the auxiliary external track 92. In other examples, a flat or concave geometry may be used. However, as shown in FIG. 7, when the second shelf portion 64 is in the fully extended position, the guide 98 of the hook member 90 may be separated a spaced vertical distance from the auxiliary external track 92 to thereby provide enough vertical spacing to enable the user to lifts the exposed front end 74 of the second shelf portion 64 and release the second shelf portion 64 from the recessed lock area 76. Despite this spaced vertical distance, the guide 98 of the hook member 90 will still engage the auxiliary external track 92 to act as a stop that limits the amount that the user can lift the exposed front end 74 of the second shelf portion 64.

Each hook member 90 is able to minimize lateral movement by engaging the auxiliary external track 92 of the frame. The hook member 90 has the "J-shaped" configuration such that it can engage either side of the auxiliary external track 92. Further still, each hook member 90 continues to engage the lower edge of the frame when the second shelf portion 64 slides toward the back panel. As the second shelf portion 64 traverses between the extended and retracted positions, the hook member 90 is generally in continuous engagement with the auxiliary external track 92. For example, as shown in FIG. 7, multiple movement stages of the second shelf portion 64 are illustrated simultaneously for explanatory purposes; in reality, the second shelf portion 64 would occupy only one of these stages at a time. The hook member indicated with reference number 90 is illustrated when the second shelf portion 64 is at the fully extended position; the hook member **90*a* is illustrated when the second shelf portion 64 has just finished the front drop down channel 80 and is proceeding along the horizontal main track; and the hook member 90*b* is illustrated when the second shelf portion 64 has reached the fully retracted position below the first shelf portion 62**.

As noted previously, the adjustable shelf 60 can be configured to fold the shelf up completely to a vertical position whereby the first and second shelf portions 62, 64 are lifted as a single unit and rotate about "C"-shaped pivot point 84 molded into the side arms 70 of the shelf frame 61 (i.e., see rotation arrow R in FIG. 5). In order to enable the second shelf portion 64 to rotate upwards, the side arms 70 of the frame 61 are configured to allow the hook members 90 to pass therethrough at a predetermined location. When the second shelf portion 64 reaches the fully retracted position below the first shelf portion 62, the hook member 90 will have traversed beyond a terminal end 99 of the auxiliary external track 92, and is separated a distance therefrom. This can be seen in FIGS. 5 and 7 (see hook member **90*b*). Thus, the hook member 90 is free and clear of the auxiliary external track 92**.

The frame further includes openings that allow the hook members to disengage from the auxiliary external track 92 as the shelf (in the "Half shelf" position) is rotated toward the back wall of the refrigerator compartment. The main track 72 can include a through hole 100 of sufficient size to enable the hook member 90 to completely pass through the main track 72. The through hole 100 is located so as to correspond to the position of the hook member 90 when the second shelf portion 64 is in the fully retracted position. As shown in FIG. 6, this position is immediately beyond the terminal end 99 of the auxiliary external track 92, although the hole 100 can be located at any suitable location after the terminal end 99 or alternatively the auxiliary external track 92 could continue after the hole 100. It is further understood that a rear portion 72*b* of the main track 72 may continue after the hole 100 to guide the rear stub shaft 73 of the second shelf portion 64. Optionally, the side arm 70 of the frame 61 can include a second hole 102 extending through a secondary support ledge 103 that supports the sides of the first shelf portion 62. The second hole 102 is located vertically above the hole 100 through the main track 72, and is similarly positioned to enable the hook member 90 to pass therethrough. Thus, when the first and second shelf portions 62, 64 are lifted as a single unit and rotate (see arrow R) about pivot point 84, the hook member 90 passes, without obstruction, vertically upwards through the hole 100 (and optionally hole 102). Conversely, when the first and second shelf portions 62, 64 are lowered back to the useable horizontal position, the hook member 90 again passes vertically downward through the hole(s) 100, 102 and is then positioned adjacent the auxiliary external track 92. It is understood that both of the side arms 70 include the hole 100 in the main track 72 (and hole 102 through secondary support ledge 103) to accommodate hook members 90 on both sides of the second shelf portion 64.

The adjustable shelf 60 has been described above as being applied mounted within the fresh food compartment 12 of the refrigerator 10. However, it is to be appreciated that the adjustable shelf 60 may be mounted within other storage compartments of the refrigerator 10 such as, for example, the VCZ compartment 14 or the freezer compartment 16.

Figure 8:
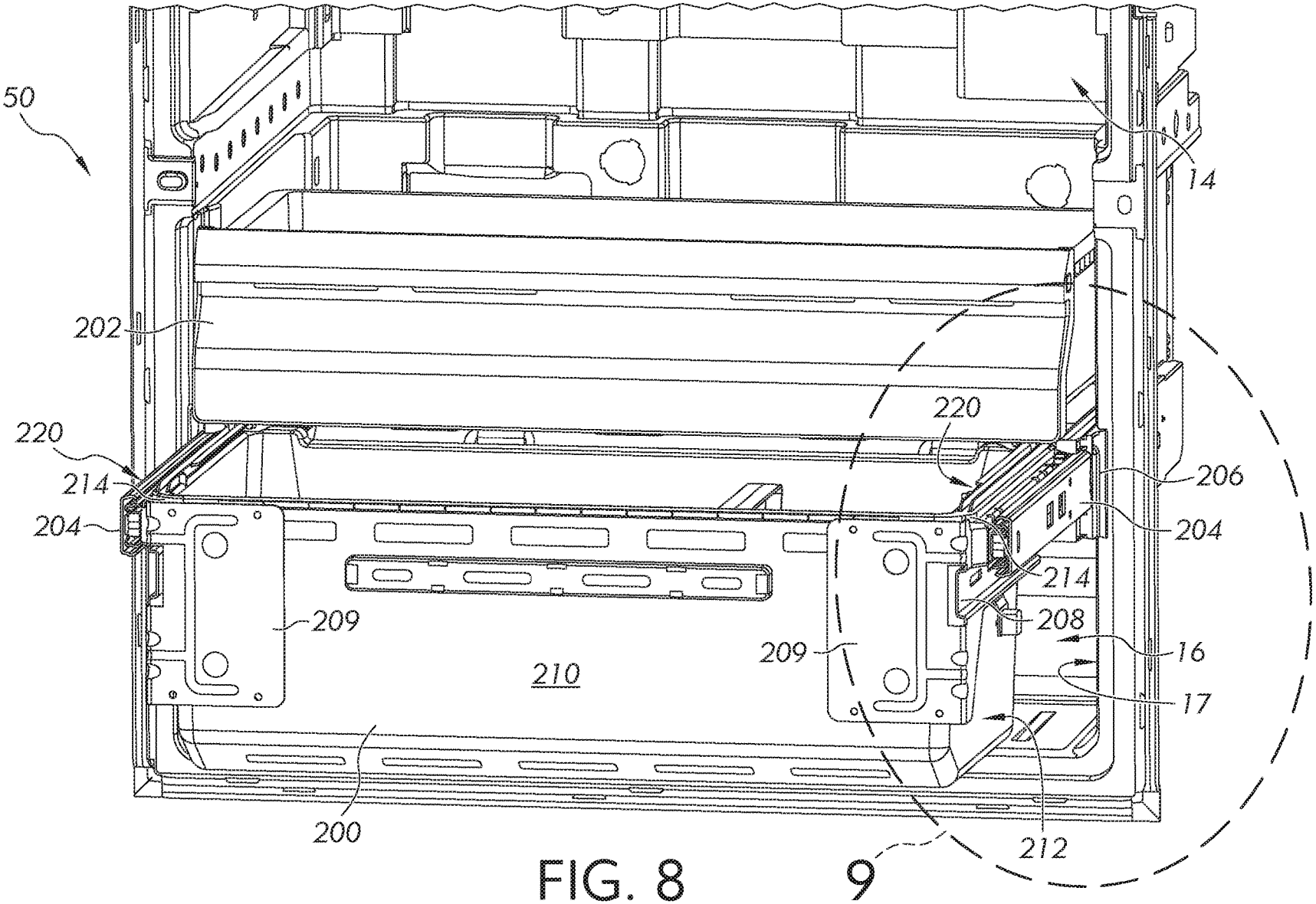
FIG. 8 is a front perspective view showing an example freezer drawer system.
Figure 9:
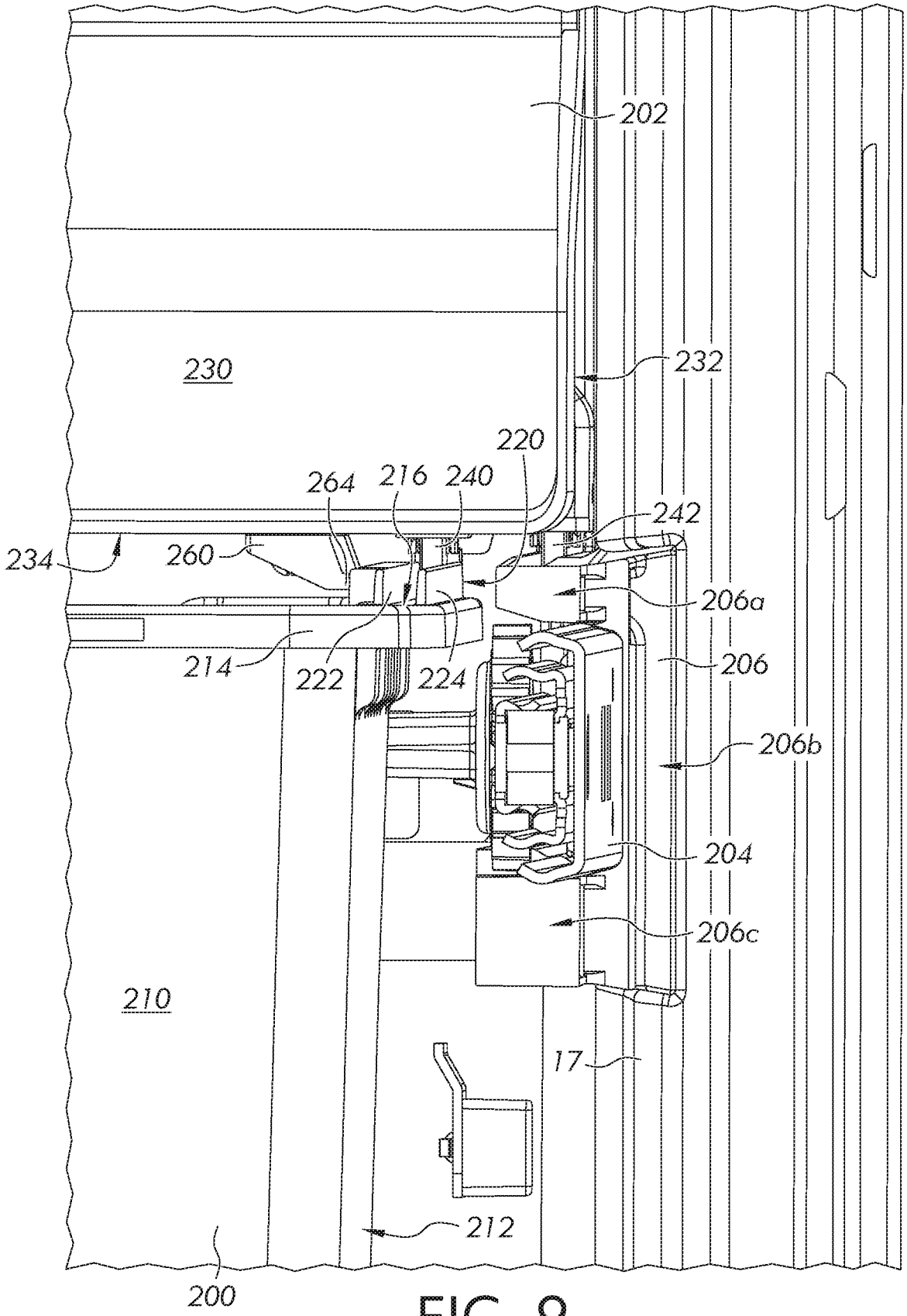
FIG. 9 is detail view "9" of FIG. 8.
Figure 10:
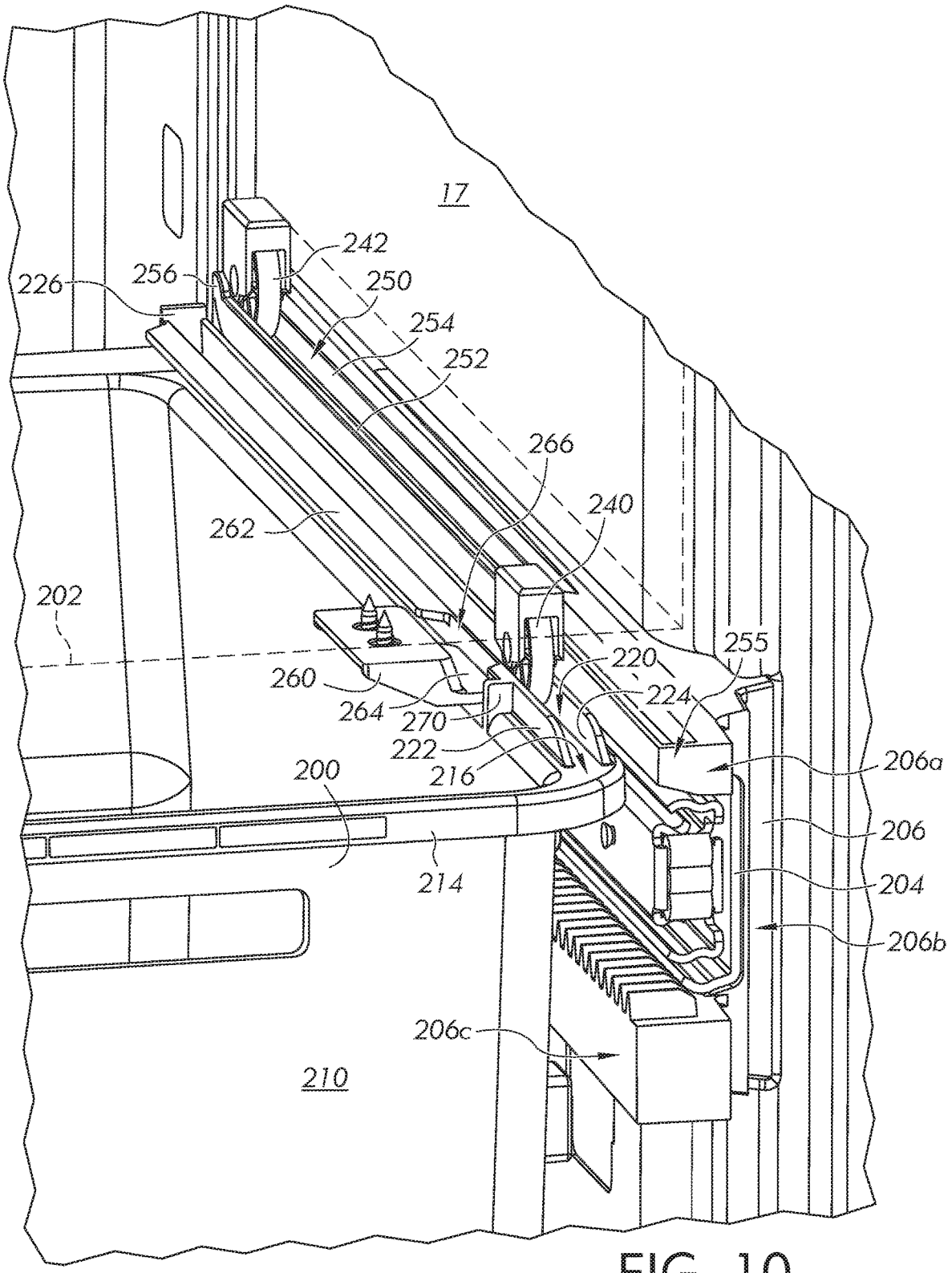
FIG. 10 is a reverse perspective view of detail "9".

Turning now to FIGS. 8-10, according to a second embodiment, the refrigerator 10 may further include a freezer drawer assembly. It is to be understood that the following discussion of the freezer drawer assembly is intended to be a separate embodiment that can be separately used from the previously described adjustable shelf. Optionally, a refrigerator can include both of the adjustable shelf assembly and the freezer drawer assembly.

As previously described with reference to FIG. 2, the freezer compartment 16 is arranged vertically beneath the VCZ compartment 14. The freezer drawer assembly 50 includes at least a pair of freezer baskets 52 that can be withdrawn from the freezer compartment 16 to grant a user access to food items stored in the freezer compartment 16. The drawer assembly can be coupled to the freezer door 54 that includes the handle 56. When a user grasps the handle 56 and pulls the freezer door 54 open, at least one or more of the pair of freezer baskets 52 is caused to be at least partially withdrawn from the freezer compartment 16.

Turning now to FIG. 8, which is a front perspective detail view, illustrated in the direction of arrow "A" of FIG. 2, showing the example freezer drawer assembly 50. For clarity, the freezer door 54 is not shown in FIGS. 8-10. More specifically, the freezer drawer assembly 50 includes a pair of baskets with a first storage basket 200 and a second storage basket 202 above the first storage basket 200, that are each individually and separately movable between a retracted position and an extended position. In the retracted position, the first and second storage baskets 200, 202 are not accessible because the freezer door 54 is closed. Conversely, in the extended position, at least one of the first and second storage baskets 200, 202, and possibly both, are accessible because the freezer door 54 is open.

The first and second storage baskets 200, 202 may each be separately formed as a monolithic body, made of a single piece of material. Alternatively, the first and second storage baskets 200, 202 may be constructed of multiple elements that are secured together as a unitary body. Preferably, the first and second storage baskets 200, 202 may be composed of a polymer material, such as an injection molded plastic. Materials other than polymer may be used so long as the baskets are of a rigid material. Preferably, the first and second storage baskets 200, 202 may also include ventilation holes of varying sizes and shapes that allow cold air to pass through the baskets.

In the following description, only one side of the first and second storage baskets 200, 202 will be described, with the understanding that the opposite side is substantially identical. The first storage basket 200 is connected to the freezer door 54 by linear motion elements 204. The linear motion element 204 may comprise any mechanism that allows for sliding. In one example, the linear motion elements 204 may be made of metal ball bearing slides or even a roller style slide or the like. The pair of linear motion elements 204 may be installed between the first and second interior side walls 17 of the freezer compartment 16 and the first storage basket 200. The linear motion elements 204 are provided on the first storage basket 200, for example, one on each side. Each linear motion element 204 comprises an outer slide member fixed to a support bracket 206 at one interior side wall 17 of the freezer compartment 16. Optionally, the support bracket 206 may further comprise a linear gear track for use with a timing bar pinion gear that may be used to ensure smooth and even opening of the first storage basket 200. An inner slide member is fixed to and slides together with the first storage basket 200 as it is moved between the extended and retracted positions. The inner slide member is fixed to the first storage basket 200 in any suitable manner. In one example, the inner slide member is fixed to a support frame 208 that includes one or more protrusions (not shown) extending upward from the support frame 208, and the first storage basket includes two downward-facing corresponding hollow openings on the underside of a flange at the top portion of both lateral side walls of the first storage basket 200. The first storage basket can be attached to the inner slide member by inserting the protrusions of the support frame 208 into the corresponding openings. Additionally, the support frame 208 can include door attachment members 209 that are rigidly fixed to an interior surface of the freezer door 54 so that opening and closing of the door 54 thereby causes corresponding opening and closing movement of the first storage basket 200.

The second storage basket 202 is located above the first storage basket 200, and is separately movable with relation to the first storage basket 200. As will be described, the second storage basket 202 is held upon the top of the first storage basket 200 and is movable upon a track system.

The first storage basket 200 is defined by a front wall 210, a rear wall and opposed sidewalls 212 that define a first storage space. The opposed sidewalls 212 of the first storage basket 200 are arranged adjacent to the first and second interior walls of the freezer compartment 16. A projecting flange 214 may extend along at least the opposed sidewalls 212, and preferably extends along and circumscribes all sides of the first storage basket 200 around the entire upper basket opening into the first storage space. The projecting flange 214 projects a distance outwards and away from the opposed sidewalls 212, and defines a substantially planar upper flange surface 216. Preferably, the planar upper flange surface 216 is parallel to the linear motion element 204, and more preferably, is also parallel to the first and second interior walls of the freezer compartment 16. The planar upper flange surface 216 extends along the direction of the door 54 opening and closing motion. The planar upper flange surface 216 provides a primary track 220 for sliding motion of the second storage basket 202.

Turning now to FIGS. 9-10, the primary track system will be described in more detail. For visual clarity of the various elements, the support frame 208 is removed in FIGS. 9-10 and the second storage basket 202 is illustrated by a simple bounding box in FIG. 10. The primary track 220 comprises a pair of parallel, opposing track sidewalls 222, 224 that define a path. The path extends linearly along the planar upper flange surface 216 in the direction of the door 54 opening and closing motion. Preferably, the path is parallel to the linear motion element 204. The opposing track sidewalls 222, 224 project upwards from, and stand proud upon, the planar upper flange surface 216. In one example, the opposing track sidewalls 222, 224 are formed together with the planar upper flange surface 216 as a monolithic body, although the opposing sidewalls 222, 224 could be separately attached. Preferably, the opposing track sidewalls 222, 224 have similar or identical heights, although they may be different.

At a rearward end of the path, the primary track 220 includes a rear wall 226 that interconnects the opposing track sidewalls 222, 224. The rear wall 226 can be adjacent to, or even co-extensive with, a rear wall of the first storage basket 200. The primary track 220 is open at a front end of the path. In other words, there is no wall or stop that interconnects the opposing track sidewalls 222, 224 at the end of the path adjacent to the front wall 210 of the first storage basket 200.

As noted above, the second storage basket 202 is located above the first storage basket 200, and is separately movable with relation to the first storage basket 200. The second storage basket 202 comprises a front wall 230, opposing side walls 232, and a bottom wall 234 that define a second storage space. The bottom wall 234 of the second storage basket 202 is arranged in a covering relationship over the upper opening of the first storage space of the first storage basket 200. The second storage basket 202 travels above the first storage basket 200 and does not enter the first storage space.

The second storage basket 202 further includes a pair of first rollers 240 at the front corners of the basket 202 and a pair of second rollers 242 at the back corners of the basket 202. The pair of first rollers 240 support the front end of the second storage basket 202, while the pair of second rollers 242 support the rear end of the second storage basket 202. The first and second rollers 240, 242 comprise a rotating wheel on an axle supported by a suitable rotational element, such as bearings or bushings. The first and second rollers 240, 242 vertically support the second storage basket 202 upon the top of the first storage basket 200 within the freezer compartment 16. As shown in FIGS. 9-10, the first rollers 240 are attached to the bottom wall 234 of the second storage basket 202 and travel along the primary track 220 (i.e., along the planar upper flange surface 216 of the first storage basket 200). The first rollers 240 are guided along the path of the primary track 220 by the track sidewalls 222, 224. Thus, as the second storage basket 202 is moved between the extended and retracted positions within the freezer compartment 16, the first rollers 240 roll along the path of the primary track 220 and are laterally maintained upon the planar upper flange surface 216 of the first storage basket 200 by engagement with the track sidewalls 222, 224. Preferably, the tolerance distance between each of the track sidewalls 222, 224 and each side of the first rollers 240 and is rather small, for example, 1 mm or less. Thus, when the first rollers 240 travels along the path of the primary track 220, smooth gliding action of the second storage basket 202 is maintained parallel to the first and second interior walls of the freezer compartment 16. As shown in FIGS. 9-10, at the fully extended position of the second storage basket 202, the first rollers 240 are located near the open end of the track; at the fully retracted position, the first rollers 240 are adjacent to, and optionally abutting, the rear wall 226 that interconnects the opposing track sidewalls 222, 224.

The rear of the second storage basket 202 is vertically supported by the pair of second rollers 242 are located at the back corners of the second storage basket 202. Preferably, the second rollers 242 are attached to the exterior side walls 232 of the second storage basket 202 via a suitable housing or bracket that may be integrally formed with the second storage basket 202, or attached separately thereto. Due to the housing or bracket, the second rollers 242 are laterally offset outwards with respect to the first rollers 240 (i.e., relatively closer to the interior side walls 17 of the freezer compartment 16).

The second rollers 242 travel along a secondary track 250. The secondary track 250 is coupled to the side wall 17 of the freezer compartment 16, and is arranged to be parallel to the primary track 220. In one example, the secondary track 250 is formed with or attached to the support bracket 206 that attaches the linear motion element 204 to the interior side wall 17 of the freezer compartment 16. In other examples, the secondary track 250 can be an independent element separately attached to the side wall 17 of the freezer compartment 16. Where the secondary track 250 is formed with or attached to the support bracket 206, the secondary track 250 can be provided on the uppermost surface of the support bracket 206. In one example, the support bracket 206 can comprise a generally "C" shape with an upper wall **206*a*, an inner side wall 206*b*, and a lower wall 206*c*. The secondary track 250 is provided on the upper wall 206*a*; the outer slide member of the linear motion element 204 is attached to the inner side wall 206*b*; and the linear gear track 207 for the pinion gears of the timing bar is formed with or attached to the lower wall 206*c*. Optionally, to reduce vertical space, the secondary track 250 can be provided as a recess into the upper wall 206*a* of the support bracket 206**.

The second rollers 242 are guided along the second path of the secondary track 250 by the track sidewalls 252, 254. Thus, as the second storage basket 202 is moved between the extended and retracted positions within the freezer compartment 16, the second rollers 242 roll along the second path of the secondary track 250 and are laterally maintained upon the upper wall **206*a* of the support bracket 206 by engagement with the track sidewalls 252, 254. Preferably, the tolerance distance between each of the track sidewalls 252, 254 and each side of the second rollers 242 and is rather small, for example, 1*mm* or less. The secondary track 250 is substantially parallel to the primary track 220, and thus smooth gliding action of the second storage basket 202 is maintained parallel to the first and second interior walls of the freezer compartment 16. As shown in FIGS. 9-10, at the fully extended position of the second storage basket 202, the second rollers 242 are located near a front wall 255 that that interconnects the track sidewalls 252, 254 of the secondary track 250; at the fully retracted position, the second rollers 242 are adjacent to, and optionally abutting, a rear wall 256 that interconnects the track sidewalls 252, 254**.

When the freezer drawer door 54 is moved forwardly or rearwardly, the first storage basket 200 will travel along the same path as the freezer door 54 due to the first storage basket's attachment to the linear slides 204. The first storage basket 200 also travels the same distance as the freezer door 54 because of the first storage basket's attachment to the door 50. However, because the second storage basket 202 is independently moveable upon the first storage basket 200, and the second storage basket 202 may travel a selective different distance than the freezer door 54. Indeed, due to the inertia of the second storage basket 202 caused by the physical weight of the food stored there, the second storage basket 202 will often remain unmoved when the freezer door 54 and first storage basket 200 are moved to the open position. Thereafter, the user can selectively manipulate (e.g., slide) the second storage basket 202 between the fully extended and retracted positions.

Suitable guides and stops can be provided to facilitate movement of the second storage basket 202. As shown in FIG. 10, the second storage basket 202 further includes a depending arm 260 that is affixed to the bottom wall 234 by screws, or other suitable mechanical fastener. Optionally, the depending arm 260 could be integrally molded together with the bottom wall 234. The depending arm 260 extends downward towards the first storage basket 200. The inward sidewall 222 of the primary track 220 further includes a flange 262 that projects inwards towards first storage space of the first storage basket 200. The flange 262 is extends perpendicularly inwards from the uppermost edge of the sidewall 222. The depending arm 260 includes a protrusion 264 that slidably engages with the flange 262 on the inward sidewall 222. The depending arm 260 travels along the primary track 220 together with the second storage basket 202 as it is moved forward and rearward. Interaction between the flange 262 and the depending arm 260 prevents the second storage basket 202 from being lifted upwardly.

In particular, the depending arm 260 extends downward from underside of the second storage basket 202 and the protrusion 264 rides under, or in sliding engagement with, the the flange 262 of the inward sidewall 222 to inhibit the first rollers 240 from moving vertically out of the primary track 220. Thus, vertical forces upon the second storage basket 202 are resisted by contact between the protrusion 264 the flange 262 of the inward sidewall 222. This prevents accidental vertical "lift-off" of the upper second storage basket 202 from the lower first storage basket 200 when the second storage basket 202 is slidingly moved manually by the user. However, it can be desired to occasionally remove the second storage basket 202 from the freezer compartment 16, such as for cleaning. Thus, flange 262 can comprise an opening 266 of sufficient size to enable the protrusion 264 to vertically pass therethrough. In this way, the front of the second storage basket 202 can be vertically lifted up and off of the first storage basket 200, and out of the freezer compartment. The flange 262 can be present on either side of the opening 266, or the opening 266 can define a terminal end of the flange 262. Preferably, the location of the opening 266 corresponds to the fully extended position of the second storage basket 202. It is further to be appreciated that both of the primary and secondary tracks 220, 250 are fully open at the top so that the first and second rollers 240, 242 are readily removable in a vertical direction.

Although the protrusion 264 of the depending arm 260 rides under, or in sliding engagement with, the flange 262 of the primary track 220, the terminal end of the protrusion 264 does not laterally touch the exterior face of the sidewall 222 of the primary track 220. This is because the distance between the terminal end of the protrusion 264 and the exterior face of the sidewall 222 is greater (typically more than 1*mm*) than the distance between the first roller 240 and the interior faces of the sidewalls 222, 224 (typically less than 1 mm). As a result, the first roller 240 would impact the sidewalls of the primary track 220 before the terminal end of the protrusion 264 impacted the exterior face of the sidewall 222.

When the second storage basket 202 is at the fully retracted position, the second rollers 242 is preferably in abutment with the rear wall 256 of the secondary track 250. This engagement physically notifies the user that the second storage basket 202 is fully retracted, which provides maximum access to the first storage space of the first storage basket 200. Optionally, the first roller 240 may also be in abutment with the rear wall 226 of the primary track 220.

Because the primary track 220 is open at a front end of the path, and alternative front stop is provided. As shown in FIG. 10, the first storage basket 200 comprises a front stop 270 that extends inwardly from to the primary track 220 towards the first storage space for engagement with the protrusion 264 of the depending arm 260. Preferably, the front stop 270 extends perpendicular from the inward sidewall 222, although it could also be arranged at an angle. The front stop 270 is only configured to prevent forward movement of the depending arm 260 in the direction of the freezer door opening and closing, and thereby the second storage basket 202, and otherwise has no effect on controlling lateral movement of the depending arm 260. This engagement between the front stop 270 and the depending arm 260 physically notifies the user that the second storage basket 202 is fully extended, which provides maximum access to the second storage space of the second storage basket 202. Optionally, the second roller 242 may also be in abutment with the front wall 255 of the secondary track 250.

The front stop 270 can be located together with a flange 262 that stops the user from lifting up the storage basket 202 when it is in fully open position. For example, a portion of the flange 262 can be disposed above the front stop 270 to inhibit vertical movement of the second storage basket 202. In another example, the opening 266 in the flange 262 can be disposed above the front stop 270 to provide an indication that the user can vertically lift the second storage basket 202.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

The invention claimed is:

1. A refrigerator with an adjustable shelf comprising:

a food compartment with a rear wall and a door configured to provide access to the food compartment; and an adjustable shelf for storing food items within the food compartment, the adjustable shelf attached to the rear wall and comprising:

a first shelf portion for supporting food items thereon, comprising a first planar support surface that is arranged normal to the rear wall;

a second shelf portion for supporting food items thereon, comprising a second planar support surface, the second shelf portion being slidably moveable relative to the first shelf portion between an extended position and a retracted position, wherein at the extended position, the second shelf portion is arranged relative to the first shelf portion such that the second planar support surface is substantially coplanar with the first planar support surface, and wherein at the retracted position, a majority of the second planar support surface is arranged subjacent to the first planar support surface;

a frame configured to support the first and the second shelf portions, wherein the frame includes two opposed side arms that each include a main track that guides the second shelf portion as the second shelf portion is slidably moved between the extended and retracted positions;

an auxiliary external track disposed on an extended lower edge of the frame, the auxiliary external track following the main track; and a hook member attached to and protruding downwards from the second shelf portion, the hook member engaging with and sliding along the auxiliary external track to minimize lateral movement of a front end of the second shelf portion as the second shelf portion is slidably moved between the extended and retracted positions.

2. The refrigerator with an adjustable shelf of claim 1, wherein the auxiliary external track comprises a planar wall.

3. The refrigerator with an adjustable shelf of claim 1, wherein the auxiliary external track is an extension of an interior sidewall of the frame.

4. The refrigerator with an adjustable shelf of claim 1, wherein the main track comprises a ramped, front drop down channel and a horizontal section, and wherein the auxiliary external track has a ramped front portion that extends below and follows the front drop down channel, and a horizontal portion that follows along the horizontal section of the main track.

5. The refrigerator with an adjustable shelf of claim 1, wherein the hook member has a "J"-shaped geometry.

6. The refrigerator with an adjustable shelf of claim 5, wherein the hook member comprises an interior arm that extends downwardly from the second shelf portion, an exterior arm, and a projecting guide interconnected between the interior and exterior arms.

7. The refrigerator with an adjustable shelf of claim 6, wherein the second shelf portion comprises a body that supports the second planar support surface, and the interior arm extends downwardly from the body.

8. The refrigerator with an adjustable shelf of claim 6, wherein the guide has a width slightly wider than a thickness of the auxiliary external track so that the auxiliary external track is captured between the interior and exterior arms.

9. The refrigerator with an adjustable shelf of claim 1, wherein the main track further comprises a hole extending therethrough to disengage the hook member from the auxiliary external track.

10. The refrigerator with an adjustable shelf of claim 9, wherein the hole is located is immediately beyond a terminal end of the auxiliary external track.

11. The refrigerator with an adjustable shelf of claim 9, wherein the hole is of sufficient size to enable the hook member to completely pass through the main track.

12. The refrigerator with an adjustable shelf of claim 9, wherein the first shelf portion is pivotally connected to the frame and, in the retracted position, the second shelf portion is coupled to the first shelf portion so that first and second shelf portions can be rotated upwards as a single unit.

13. The refrigerator with an adjustable shelf of claim 12, wherein the hook member passes without obstruction vertically upwards through the hole in the main track when the first and second shelf portions are rotated upwards.

14. The refrigerator with an adjustable shelf of claim 1, further comprising a pair of auxiliary external tracks disposed one each on the opposed side arms of the frame, and a pair of hook members disposed one on each side of the second shelf portion that are engaged with and ride along the auxiliary external tracks on both opposed side arms.

* * * * *